US007208245B2

(12) United States Patent
Moon et al.

(10) Patent No.: US 7,208,245 B2
(45) Date of Patent: Apr. 24, 2007

(54) ADAPTER CAP FOR SEALED LEAD ACID BATTERY

(75) Inventors: Brian Moon, Dekalb, IL (US); Lyle A. Rosine, Batavia, IL (US)

(73) Assignee: Suncast Corporation, Batavia, IL (US)

( * ) Notice: Subject to any disclaimer, the term of this patent is extended or adjusted under 35 U.S.C. 154(b) by 619 days.

(21) Appl. No.: 10/394,523

(22) Filed: Mar. 21, 2003

(65) Prior Publication Data

US 2004/0005817 A1 Jan. 8, 2004

Related U.S. Application Data

(63) Continuation-in-part of application No. 10/346,908, filed on Jan. 17, 2003, now Pat. No. 6,877,687, which is a continuation-in-part of application No. 29/154, 133, filed on Jan. 28, 2002, now abandoned.

(51) Int. Cl.
*H01M 2/20* (2006.01)
*H01M 2/08* (2006.01)
*H01R 13/40* (2006.01)

(52) U.S. Cl. ..... 429/65; 429/121; 429/175; 439/625

(58) Field of Classification Search ..... None
See application file for complete search history.

(56) References Cited

U.S. PATENT DOCUMENTS

| | | | | |
|---|---|---|---|---|
| 3,963,972 | A * | 6/1976 | Todd | 320/112 |
| 4,012,002 | A | 3/1977 | McDonald et al. | |
| 4,513,772 | A | 4/1985 | Fisher | |
| 4,832,074 | A | 5/1989 | Li | |
| 5,495,995 | A | 3/1996 | Dominique et al. | |
| 6,149,096 | A | 11/2000 | Hartley | |

* cited by examiner

*Primary Examiner*—Jonathan Crepeau
(74) *Attorney, Agent, or Firm*—McHale & Slavin, P.A.

(57) ABSTRACT

An adapter cap for a sealed lead acid battery comprises a non-conductive housing having a base perimeter adapted for flush alignment with the top surface of a battery which is dimensioned to encompass the tab terminals of the battery. Conductive material is secured to the housing and extends through a portion of the housing which is configured as a female connectors adapted for sliding engagement with the battery tab terminals to provide an electrical coupling external to the housing. A recharging jack is disposed in the housing which is electrically coupled to the portions of conductive material. The housing including an aperture therein to receive a mated component for the recharging jack, whereby the adapter cap provides a charging connection that protects the battery tabs and a recharging connection electrically coupled to the battery tabs.

12 Claims, 6 Drawing Sheets

ADAPTER CAP FOR SEALED LEAD ACID BATTERY

CROSS REFERENCE TO RELATED APPLICATIONS

This application is a continuation-in-part of applicant's U.S. application Ser. No. 10/346,908 now U.S. Pat. No. 6,877,687 filed Jan. 17, 2003, which is a continuation-in-part of applicant's U.S. application Ser. No. 29/154,133 filed Jan. 18, 2002, now abandoned, the contents of which are hereby incorporated by reference.

FIELD OF THE INVENTION

This invention relates generally to sealed rechargeable lead acid batteries, and more particularly to a battery adapter cap which cooperates with a complementary housing to provide for self-aligning insertion of the battery, and which also includes an integrated recharging jack.

BACKGROUND OF THE INVENTION

Sealed rechargeable lead acid batteries for use in portable electrical equipment are often manufactured as compact rectangular containers having FASTON tab type terminals on the top surface. The FASTON tab terminals are electrically coupled to a device by sliding mated female connector portions onto the tab terminals. This prior art arrangement usually required handling of the lead wires at the time of installation of the battery, and is thus not a particularly "user friendly" arrangement. Difficulties can be encountered in this type of installation, such as the displacement of the battery causing the connectors to be pulled from the tab terminal. Also, the tab connectors can become distended with repeated use and easily dislodged from the tab terminals.

In another prior art installation arrangement, the battery is slidlingly inserted into a mated compartment having electrical touch which engage with the FASTON tab terminals. A drawback of this arrangement is that the tab terminals can become flattened until they no longer properly aligned with the electrical contacts.

In view of the problems associated with the prior art battery installation arrangements, it would be highly desirable to provide an adapter cap for a sealed battery having FASTON tab terminals which provides a leadless installation arrangement, and thus provides an ease of installation comparable to that of a standard dry cell battery.

Another drawback is seen in the prior art procedure charging of the sealed lead acid battery. Charging the battery is typically accomplished by attaching a pair of alligator clips to the tab terminals. This charging procedure is relatively awkward, as mishandling of the clips can lead to inadvertent contact. The present invention solves this and other prior art problems by providing a adapter cap for a sealed lead acid battery which couples the tab terminals to an integrated charging jack.

SUMMARY OF THE INVENTION

It is an objective of the invention to provide an adapter cap for a sealed lead acid battery which provides for leadless installation into a battery compartment.

It is another objective to provide an adapter cap for a sealed lead acid battery which cooperates with a complementary battery compartment housing for self-aligning installation for electrical connection.

It is still another objective to provide an adapter cap for a sealed lead acid battery which engages with FASTON tab terminals to secure the cap to the battery and provide an external electrical coupling.

It is a further objective of the invention to provide an adapter cap for a sealed lead acid battery which includes an integrated standard A/C charging jack.

In accordance with the above objectives, an adapter cap for a sealed lead acid battery is provided which includes a non-conductive housing having a base perimeter adapted for flush alignment with the periphery of the top surface of a battery which is dimensioned to encompass the tab terminals of the battery. Conductive material is secured to the housing and extends through a portion of the housing which is configured as female connectors adapted for sliding engagement with the battery tab terminals to provide an electrical coupling external the housing.

A recharging jack is disposed in the housing which is electrically coupled to the portions of conductive material. The housing including an aperture therein to receive a mated component for the recharging jack, whereby the adapter cap provides a charging connection that protects the battery tabs and a recharging connection electrically coupled to the battery tabs.

The housing can be formed from injection molded plastic, and can be configured as an open shell defining an interior surface and an exterior surface. The housing has a central portion having a first greater height and two adjoining terminal receiving portions having a second lower height. The terminal receiving portions have apertures extending there through wherein positioned to align with the tab terminals. The housing has an elongate construction having a longitudinal axis. The central portion of the housing has a planar top surface, front surface, and rear surface and opposing side surfaces contiguous formed with the terminal receiving portion, and each of the terminal receiving portions have a top surface constructed to have a pair of linearly inclined symmetrical surfaces intersecting at the longitudinal axis and extending downwardly to the base perimeter. The apertures in the terminal receiving portions are coincident with the longitudinal axis of the housing.

The conductive material includes two strips of conductive material secured to the housing, each strip having a portion formed as a female tab connector which is positioned adjacent to the interior surface. The strips respectively extend through the apertures such that a portion of the strips is positioned adjacent the exterior surface, whereby the adapter cap can be secured to the battery by insertion of the tab terminals into the female tab connectors.

The aperture for the recharging jack extends through the rear surface of the central portion, and the interior surface of the housing includes a securement means to maintain the recharging jack within the housing in alignment with the aperture. The securement means includes a clip structure adapted for tensioned engagement with the recharging jack, and can be integrally formed with the housing.

DETAILED DESCRIPTION OF THE INVENTION

Although the invention will be described in terms of a specific embodiment, it will be readily apparent to those skilled in this art that various modifications, rearrangements, and substitutions can be made without departing from the spirit of the invention. The scope of the invention is defined by the claims appended hereto.

Figure 1:
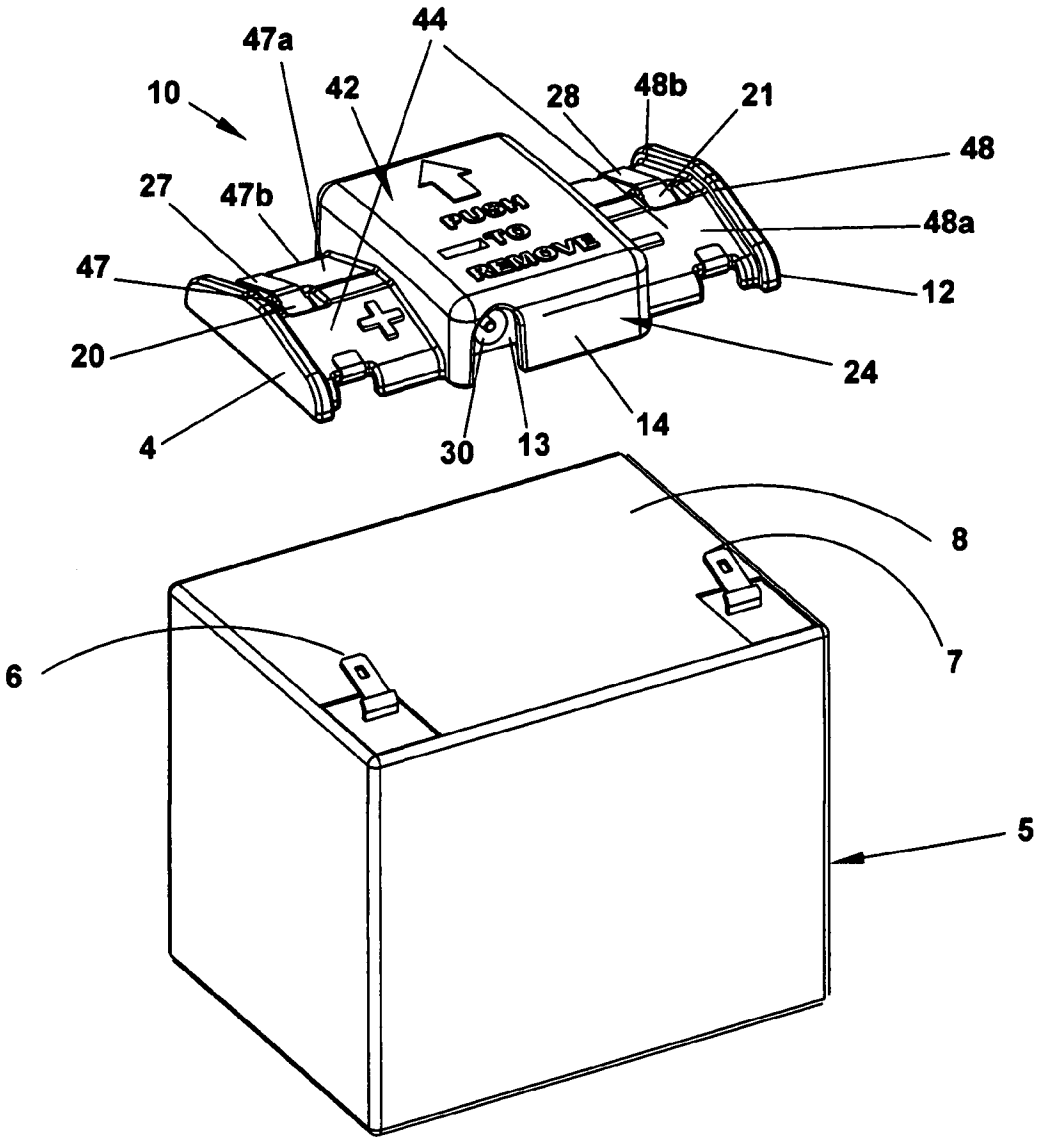
FIG. 1 is a perspective view of the adapter cap of the invention prior to installation to a sealed lead acid battery.
Figure 2:
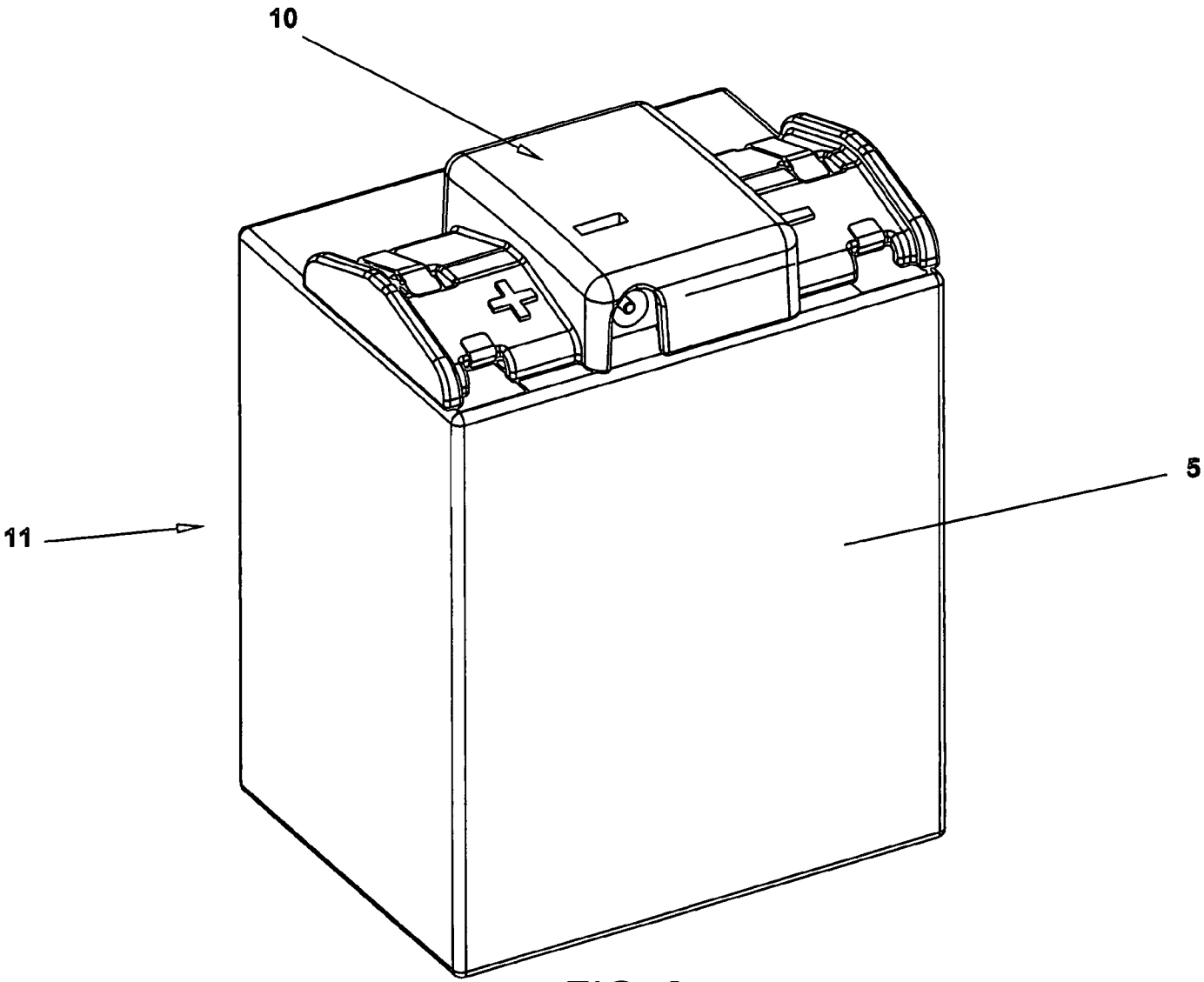
FIG. 2 illustrates the adapter cap of FIG. 1 in an installed configuration.

Referring to FIG. 1, there is seen an adapter cap 10 according to a preferred embodiment of the invention which is to be attached to the sealed lead acid battery 5 having positive and negative FASTON tab terminals 6 and 7. The adapter cap 10 includes a housing 12 formed from a non-conductive material, preferably injection molded plastic. The cap 10 has a base perimeter 14 adapted for flush alignment with the periphery of the top surface 8 of the battery 5. The housing 12 is dimensioned to encompass the tab terminals 6 and 7. FIG. 2 illustrates the adapter cap in an installed configuration on the battery 5 to form battery assembly 11. The housing 12 is preferably configured to appear integrally constructed with the battery 5 after installation.

Figure 3:
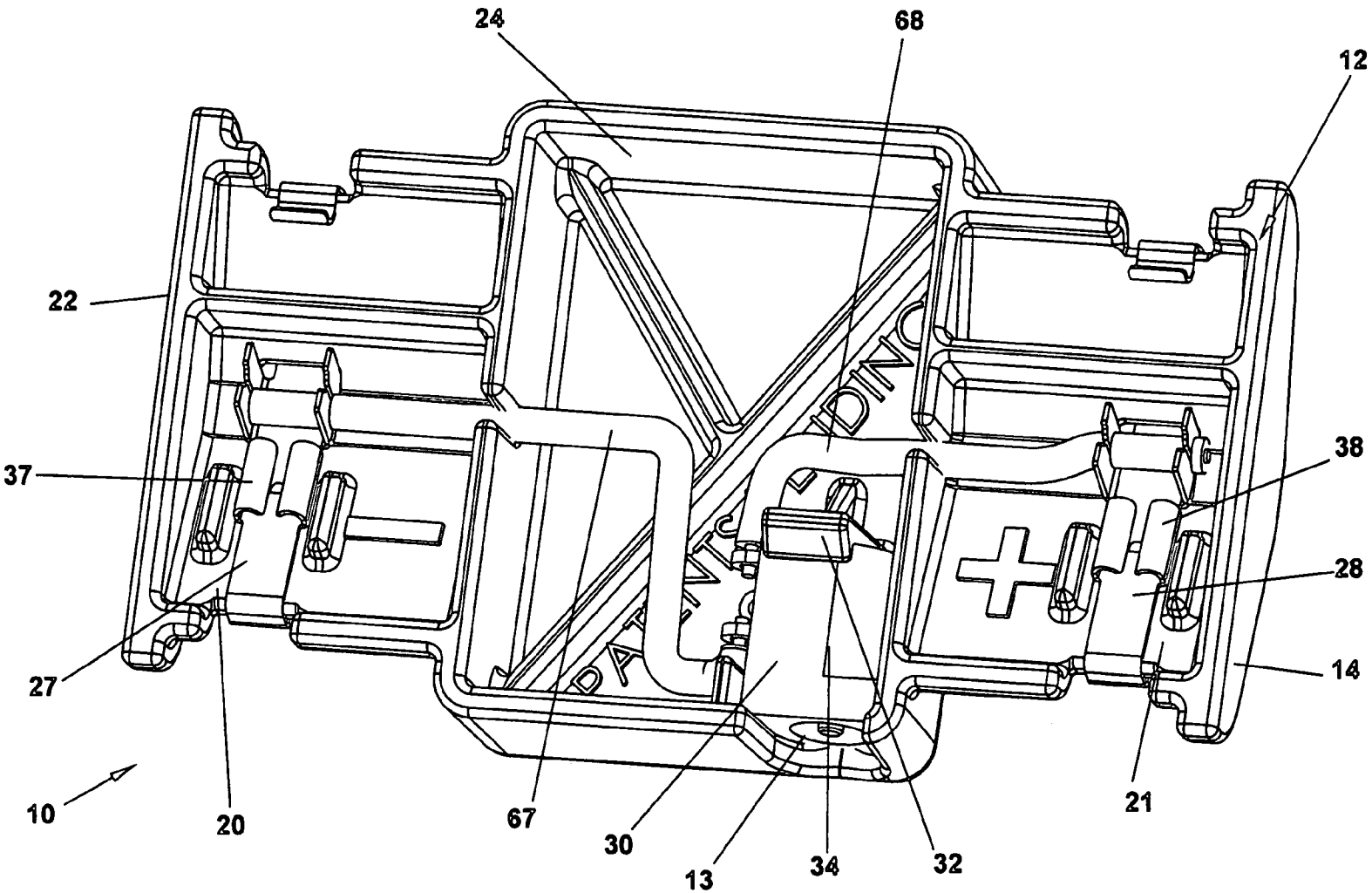
FIG. 3 is a bottom view of the adapter cap of FIG. 1.

The housing 12 has an elongated construction preferably formed as an open shell defining an exterior surface 22, and an interior surface 24, which can be seen in FIG. 3. The housing 12 includes two apertures 20 and 21 which are positioned to respectively align with the tab terminals 6 and 7. Strips of conductive material 27 and 28 are secured to the housing 12, and respectively extend through the apertures 20 and 21. As can be seen in FIG. 3, portions of the strips of conductive material 27 and 28 adjacent the interior surface 24 are configured as female connectors 37 and 38 which are adapted for sliding engagement with the tab terminals 6 and 7. As seen in FIG. 1, portions of the strips 27 and 28 are adjacent to the exterior surface 22, thus providing an electrical coupling external the housing 12. The strips of conductive material 27 and 28 can be secured to the housing 12 in any suitable manner. In the preferred embodiment, the strips 27 and 28 are formed in a S-configuration and have end portions formed as clips for engaging the base perimeter 14.

In the preferred embodiment, the housing 12 has a central portion 42, and adjoining terminal receiving portions 44 and 46. The apertures 20 and 21 are positioned in the terminal receiving portions 44 and 46 and are preferably centered along the longitudinal axis a–a' of the housing 12. The central portion 42 has a generally rectangular configuration, and has a greater height than that of terminal receiving portions 44 and 46. The terminal receiving portions 44 and 46 each have top surfaces 47 and 48 which are constructed to have a pair of linearly inclined symmetrical surfaces 47*a,b* and 48*a,b* which intersect at the longitudinal axis a–a' and extend downwardly to said base perimeter 14. The angle of inclination of the top surfaces 47 and 48 is approximately equal to the angle of the tab terminals 6 and 7. In this way, the female connector portions 37 and 38 are correctly aligned for sliding engagement with the tab terminals 6 and 7.

A standard A/C recharging jack 30 is disposed in the central portion of the housing 12 which is electrically coupled to the strips of conductive material 27 and 28. The housing 12 includes an aperture 13 aligned with the recharging jack 30 to allow insertion of the mated component for recharging. The interior surface 24 of the housing includes a securement means to maintain said recharging jack 30 within said housing in alignment with the aperture 13. The interior surface 24 can include a clip structure 32 which is adapted for tensioned engagement with the recharging jack 30 to hold it in place against the aperture 13. The interior surface 24 can also include a plurality of partition walls to contain the recharging jack 30. The clip structure 32 and partition walls 34 can be integrally formed with the housing 12. As is seen in FIG. 3, the recharging jack 30 is coupled to wires 37 and 38, which are respectively coupled to conductive material strips 27 and 28.

Figure 4:
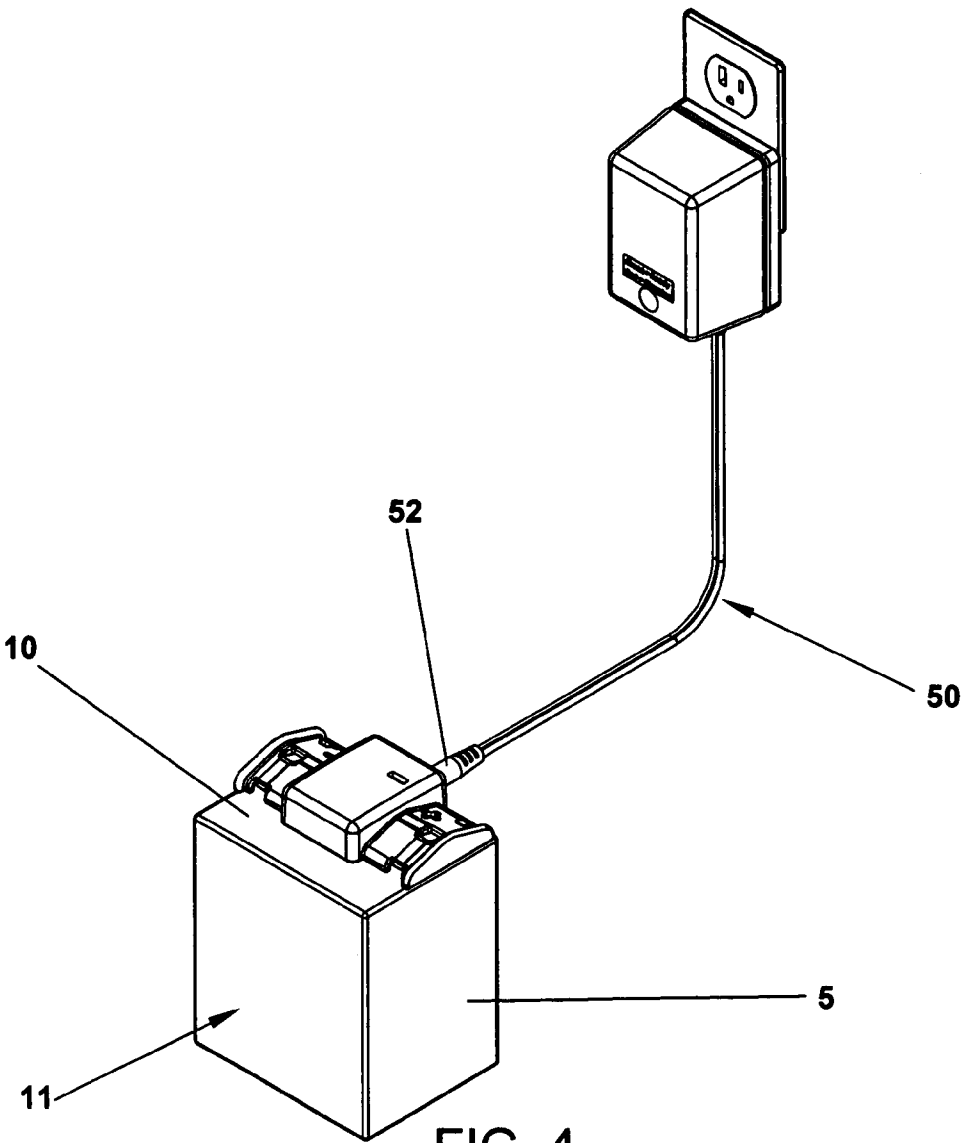
FIG. 4 illustrates the charging operation for a battery with the adapter cap of FIG. 1 installed thereon.

FIG. 4 is a perspective view of the battery assembly 11 cooperating with the battery charging means illustrated herein as battery charger 50. The battery charger 50 is constructed and arranged to utilize a plug 52 that mates with charging jack 30 for charging the battery 5. Battery chargers that utilize household current to recharge low voltage DC batteries are well known in the art and a detailed description will therefore be omitted. In an alternative embodiment, the instant invention may utilize solar cells (not shown) as a means to recharge the battery 5.

In the practice of the invention, the battery assembly 11 can be installed into a battery compartment having a complementary configuration to the battery assembly 11. A suitable housing would be approximately rectangular, with electric contacts positioned in an end wall configured for mated engagement with the adapter cap 10 and conductive strips 27, 28 when the battery assembly 11 is inserted therein. The asymmetrical configuration of the top surface of the battery assembly 11 ensures that the battery is self-aligning because the battery will not fit into the compartment in an incorrect orientation.

Figure 5:
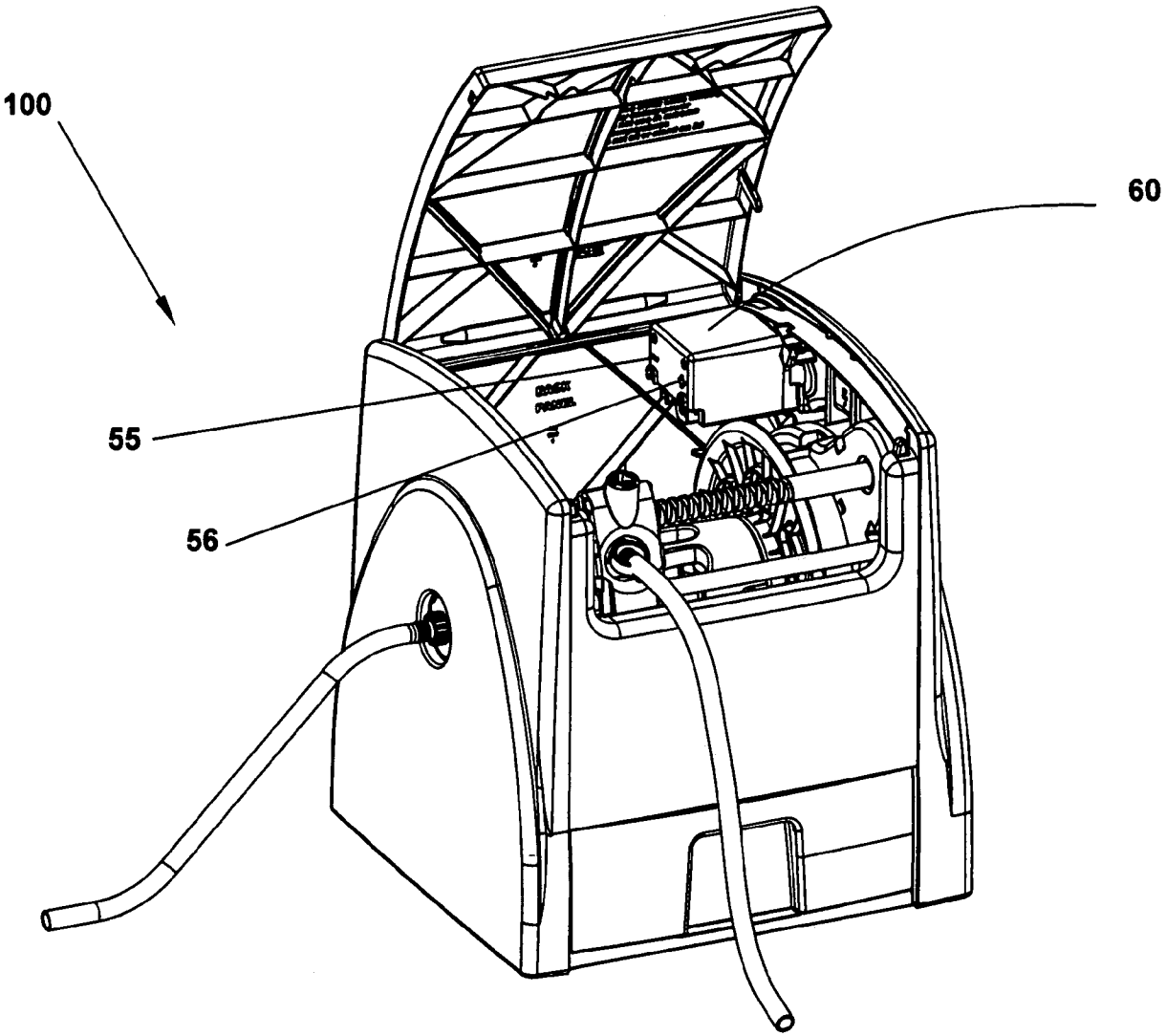
FIGS. 5 and 6 and illustrate a DC powered hose reel assembly including a housing adapted to receive adapter cap of FIG. 1.
Figure 6:
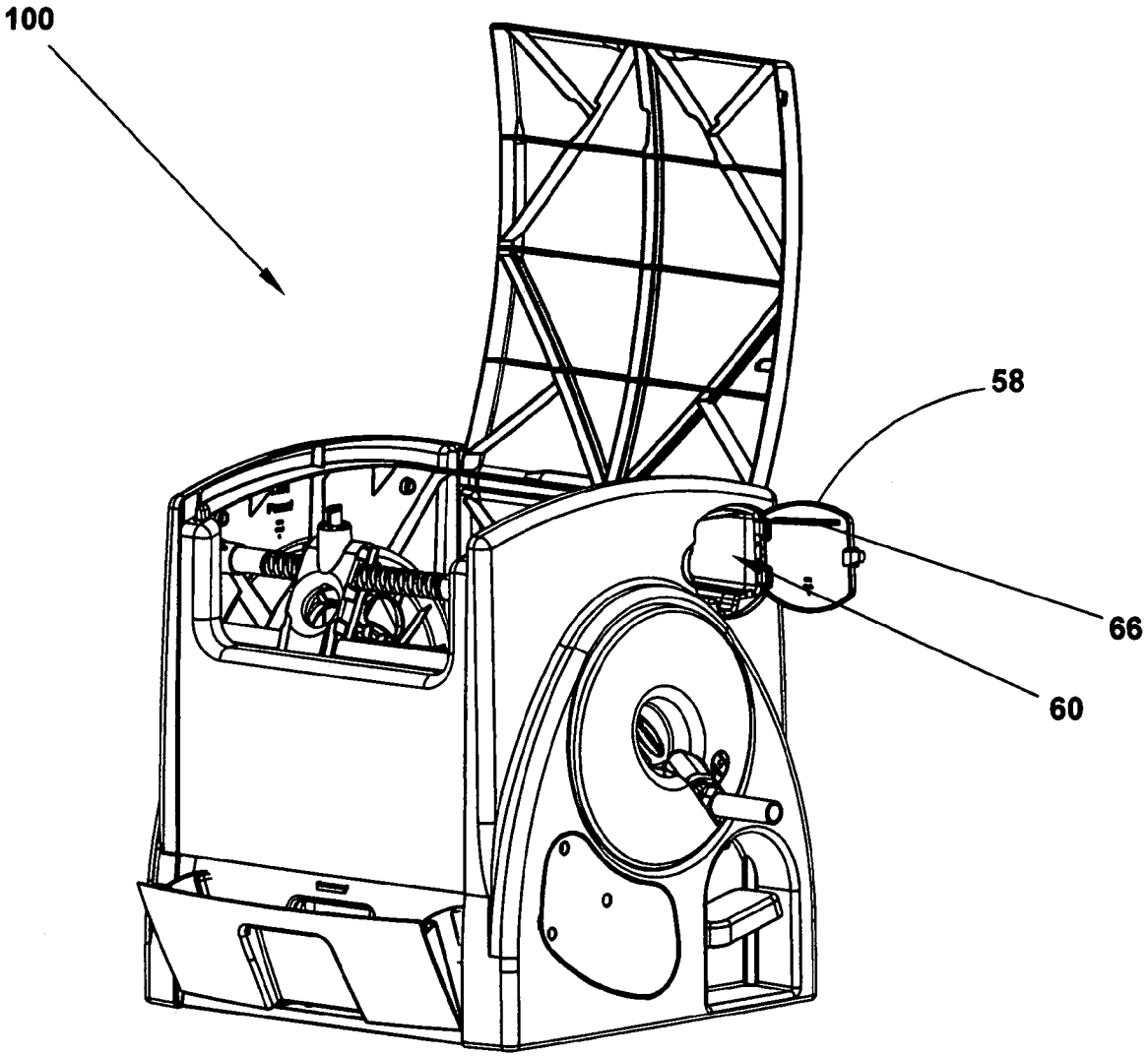

As an illustrative example, FIGS. 5 and 6 show a DC powered hose reel assembly 100 as disclosed in applicant's co-pending application Ser. No. 10/346,908, which includes a battery compartment 60 configured to engage with the adapter cap 10. The battery compartment is constructed and arranged in a manner that allows the battery assembly to be directionally slid into the compartment for electrical cooperation. That is, there is no need to connect wires to the battery assembly to operate the device. The battery compartment contains a pair of electrical contacts 55 and 56 positioned in a manner so that electrical contact is made only if the battery assembly is correctly installed.

The battery compartment 60 is provided with a hinged door 48 having a latch arrangement. Formed integrally to the inside of the battery cover door 48 is a vertical battery hold down 66. When the door 58 is latched in the closed position the battery compartment electrical contacts 55, 56 and the battery assembly electrical contacts 27, 28 are maintained in a cooperating relationship. In this manner, the battery assembly 11 is removable and replaceable without the need to attach wiring.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A rechargeable battery assembly comprising:

a sealed lead acid batter;

an adapter cap, said adapter cap comprising:

a non-conductive housing having a base perimeter constructed and arranged for flush alignment with the periphery of the top surface of said battery, said housing dimensioned to encompass tab terminals integral with said battery, wherein said housing is configured as an open shell defining an interior surface and an exterior surface; said housing having a central portion having a first greater height and two adjoining terminal receiving portions having a second lower height, and said terminal receiving portions having apertures extending there through wherein said apertures are positioned to align with said tab terminals of said battery;

conductive material secured to said housing and extending through a portion of said housing said conductive material configured as female connectors adapted for sliding engagement with said battery tab terminals providing an electrical coupling external of said housing;

a recharging jack disposed in said housing electrically coupled to said portions of conductive material, said housing including an aperture therein to receive a mated component for said recharging jack; whereby said adapter cap provides a charging connection that protects said battery tab terminals and a recharging connection electrically coupled to said battery tab terminals.

2. The rechargeable battery assembly of claim 1, wherein said housing has an elongate construction having a longitudinal axis, said central portion of said housing has a planar top surface, front surface, and rear surface and opposing side surfaces contiguous formed with said terminal receiving portion, each said terminal receiving portions have a top surface constructed to have a pair of linearly inclined symmetrical surfaces intersecting at said longitudinal axis and extending downwardly to said base perimeter.

3. The rechargeable battery assembly of claim 2, wherein said apertures in said terminal receiving portions are coincident with said longitudinal axis.

4. The rechargeable battery assembly of claim 1, wherein said conductive material comprises two strips of conductive material secured to said housing, each strip having a portion formed as a female tab connector which is positioned adjacent said interior surface, and said strips respectively extend through said apertures such that a portion of said strips is positioned adjacent said exterior surface, whereby said adapter cap can be secured to said battery by insertion of said tab terminals into said female tab connectors.

5. The rechargeable battery assembly of claim 1, wherein said aperture for said recharging jack extends through a rear surface of said central portion, and said interior surface of said housing includes a securement means to maintain said recharging jack within said housing in alignment with said aperture.

6. The rechargeable battery assembly of claim 5, wherein said securement means includes a clip structure adapted for tensioned engagement with said recharging jack.

7. The rechargeable battery assembly of claim 5, wherein said clip structure is integrally formed with said housing.

8. The rechargeable battery assembly of claim 1, wherein said housing is formed from injection molded plastic.

9. The rechargeable battery assembly of claim 1, wherein said exterior surface of said adapter cap is constructed and arranged to provide alignment for installation of said adapter cap into a battery compartment.

10. The rechargeable battery assembly of claim 9, wherein said exterior surface includes an asymmetrical configuration to provide orientation alignment for installation of said adapter cap into a battery compartment.

11. An adapter cap for a sealed lead acid battery comprising:

a non-conductive housing having a base perimeter adapted for flush alignment with the top surface of a battery, said housing dimensioned to encompass the tab terminals of said battery, wherein said housing is configured as an open shell defining an interior surface and an exterior surface; said housing having a central portion having a first greater height and two adjoining terminal receiving portions having a second lower height, and said terminal receiving portions having apertures extending there through wherein said apertures are positioned to align with said tab terminals of said battery;

said housing has an elongate construction having a longitudinal axis, said central portion of said housing has a planar top surface, front surface, and rear surface and opposing side surfaces contiguously formed with said terminal receiving portion, each said terminal receiving portions have a top surface constructed to have a pair of linearly inclined symmetrical surfaces intersecting at said longitudinal axis and extending downwardly to said base perimeter;

said apertures in said terminal receiving portions are coincident with said longitudinal axis;

conductive material secured to said housing and extending through a portion of said housing said conductive material configured as female connectors adapted for sliding engagement with said battery tab terminals providing an electrical coupling external said housing;

a recharging jack disposed in said housing electrically coupled to said portions of conductive material, said housing including an aperture therein to receive a mated component for said recharging jack; whereby said adapter cap provides a charging connection that protects said battery tab terminals and a recharging connection electrically coupled to said battery tab terminals.

12. An adapter cap for a sealed lead acid battery comprising:

a non-conductive housing having a base perimeter adapted for flush alignment with the top surface of a battery, said housing dimensioned to encompass the tab terminals of said battery, wherein said housing is configured as an open shell defining an interior surface and an exterior surface; said housing having a central portion having a first greater height and two adjoining terminal receiving portions having a second lower height, and said terminal receiving portions having apertures extending there through wherein said apertures are positioned to align with said tab terminals of said battery;

conductive material secured to said housing and extending through a portion of said housing said conductive material configured as female connectors adapted for sliding engagement with said battery tab terminals providing an electrical coupling external said housing;

said conductive material comprises two strips of conductive material secured to said housing, each strip having a portion formed as a female tab connector which is positioned adjacent to said interior surface, and said strips respectively extend through said apertures such that a portion of said strips is positioned adjacent said exterior surface, whereby said adapter cap can be secured to said battery by insertion of said tab terminals into said female tab connectors;

a recharging jack disposed in said housing electrically coupled to said portions of conductive material, said housing including an aperture therein to receive a mated component for said recharging jack; whereby said adapter cap provides a charging connection that protects said battery tab terminals and a recharging connection electrically coupled to said battery tab terminals.

* * * * *